US005501709A

United States Patent [19]

Fuchs

[11] Patent Number: 5,501,709

[45] Date of Patent: Mar. 26, 1996

[54] ECONOMY AND PLUMPING CHROME TANNING

[75] Inventor: Karlheinz Fuchs, Huenfelden, Germany

[73] Assignee: Hoechst AG, Germany

[21] Appl. No.: 105,380

[22] Filed: Aug. 12, 1993

[30] Foreign Application Priority Data

Aug. 14, 1992 [DE] Germany ..... 42 26 983.0

[51] Int. Cl.[6] ..... C14C 1/08; C14C 3/04

[52] U.S. Cl. ..... 8/94.27; 8/94.15; 8/94.18; 8/94.26; 8/94.33

[58] Field of Search ..... 8/94.15, 94.18, 8/94.2, 94.21, 94.26, 94.27, 94.33

[56] References Cited

U.S. PATENT DOCUMENTS

| | | | |
|---|---|---|---|
| 2,276,315 | 3/1942 | Kirk | 8/94.33 |
| 4,042,321 | 8/1977 | Bäcker et al. . | |
| 4,715,861 | 12/1987 | Lotz et al. . | |
| 4,938,779 | 7/1990 | Friese et al. | 8/94.27 |
| 4,978,361 | 12/1990 | Fuchs et al. | 8/94.27 |
| 5,215,542 | 6/1993 | Pore | 8/94.15 |

FOREIGN PATENT DOCUMENTS

| | | |
|---|---|---|
| 2087228 | 7/1993 | Canada . |
| 0349892 | 1/1990 | European Pat. Off. . |
| 437997 | 7/1991 | European Pat. Off. . |
| 0437997 | 7/1991 | European Pat. Off. . |
| 0551785 | 7/1993 | European Pat. Off. . |

OTHER PUBLICATIONS

Sharphouse, Leather Worker's Handbook, 1963, pp. 4–5, (Month Unknown).

Thorstensen, Practical Leather Technology, 1976, pp. 284 and 286, (Month Unknown).

*Primary Examiner*—Prince Willis, Jr.
*Assistant Examiner*—Alan D. Diamond
*Attorney, Agent, or Firm*—Connolly & Hutz

[57] ABSTRACT

The present invention relates to a process for economy and plumping chrome tanning by admixing the pelts in the pickle bath with an aldehyde- and/or keto-carboxylic acid and then tanning, which comprises, prior to the addition of the aldehyde- and/or keto-carboxylic acid with or without other organic and/or inorganic acids, pretreating the delimed and bated pelts with an anionic, colloidal silicate solution.

20 Claims, No Drawings

ECONOMY AND PLUMPING CHROME TANNING

Chrome tanning is an essential operation in leathermaking. Conventionally, to make a leather which will survive the boiling test, chromium salts are made available in a concentration that is equivalent to 2 to 2.5% by weight of $Cr_2O_3$, based on pelt weight. Of this amount, however, only 70 to 80% does in fact become permanently fixed in the hide, so that 20 to 30% of the amount of chrome tannin made available passes into the effluent.

For ecological as well as economic reasons there has therefore been no shortage of attempts in the past to improve the degree of chromium fixation in the hide and to reduce the amount of chromium necessary for tanning to boiling test resistance.

For instance, the exhaustion of the chrome tannin can be improved by increasing the tanning liquor pH above the norm. The simultaneously increased adstringency of the chrome tannins, however, leads to a drawn grain, i.e. to qualitatively inferior leathers. Usually, what is more, there is an additional loss of area.

Furthermore, improved exhaustion of the chrome tannins can be achieved by raising the tanning liquor temperature from the usual 38°–40° C. to about 45° C. However, the higher temperature likewise brings about an increase in the adstringency of the chrome tannins, so that here too there is a risk of drawn grain and loss of yield, i.e. of producing a leather of inferior quality.

It is also known from the literature that aromatic di-and tricarboxylic acids, such as phthalic acid and/or salts thereof, are used in pickling or chrome tanning to achieve better fixation of the chromium in the hide. If they are used-in the pickle, however, they cause a marked reduction in the rate of penetration of the subsequent chrome tannins, a nonuniform distribution of the chromium and, in the case of relatively thick, unsplit pelts, in some cases even an inadequate degree of penetration of the tannage. If they are to be used in chrome tanning, it is necessary, in order that these defects may be ameliorated, to carry out the tanning in—usually—two stages by using a usually organically blocked chromium(III) sulfate tannin to carry out a mild pretannage at a low pH, followed by the addition of the aromatic di- and tricarboxylic acids alone or in the presence of further chrome tannin and/or in the presence of a basifier.

U.S. Pat. No. 4,715,861 discloses an economy chrome tanning process wherein from 0.1 to 2% by weight of an aldehyde or keto-carboxylic acid, preferably glyoxylic acid, is used in the preceding pickle bath as a replacement or partial replacement for the usual sulfuric acid or formic acid. The chrome tanning is carried out in the same bath. This process produces very soft leathers having a tight grain and improved physical properties. There is a distinct improvement in the exhaustion of the chrome tanning liquors, but not enough to satisfy the raised expectations in every case.

U.S. Pat. No. 4,042,321 discloses a process in which the conventionally pickled pelts are pretanned with chromium(III) salts and tanned to completion with a mixture of chromium(III) salts, acid binders (dolomite, MgO, alkali metal and alkaline earth metal carbonates and/or bicarbonates) and aromatic di- and tricarboxylic acids (phthalic acid, isophthalic acid, succinic acid, etc.), their salts or anhydrides. Very good exhaustion of the chrome liquors is achieved. However, the leathers obtained usually have poor dyeability, a coarse grain and poor yield.

In another chrome tanning process with high exhaustion (U.S. Pat. No. 4,938,779) the pelts, tanned with from 0.5 to 12% by weight, preferably from 3 to 6% by weight, based on pelt weight, of chromium(III) salts are basified using a combination of basifiers, such as magnesium oxide and aldehyde- and/or keto-carboxylic acids, with the subsequent addition of sodium aluminum silicates.

In the economy chrome tanning process of U.S. Pat. No. 4,978,361, tanning is preceded by a pretreatment of the pelts with from 0.5 to 2.0% by weight of an aldehyde- or keto-carboxylic acid, preferably glyoxylic acid, and from 0.5 to 1.0% by weight of a mixture of chromium(III) salts, acid binders and aromatic di- and tricarboxylic acids. The pelts are then tanned in the same bath in a conventional manner and subsequently tanned to completion with from 1 to 3% by weight of a mixture of chromium(III) salts, acid binders and aromatic di- or tricarboxylic acids or their salts.

All the processes mentioned produce insufficient fullness and softness because of the much reduced amount of chromium(III) salt made available.

It is an object of the present invention to provide a chrome tanning process which is free of the aforementioned disadvantages and ensures not only an improved exhaustion of the chromium from the tanning liquor but also greater fullness, better softness and a tight grain.

This object is achieved by a process for economy and plumping chrome tanning by admixing the pelts in the pickle bath with an aldehyde- and/or keto-carboxylic acid and then tanning, which comprises, prior to the addition of the aldehyde- and/or keto-carboxylic acid with or without other organic and/or inorganic acids, pretreating the delimed and bated pelts with an anionic, colloidal silicate solution.

The anionic colloidal silicate solution used is usually an aqueous dispersion of colloidal, anionically charged silicon dioxide particles, preferably a silica sol.

The aqueous dispersion is usually prepared by in-situ growth from silicon dioxide micronuclei and not by redispersing existing particles. The silicon dioxide particles thus prepared are nonporous and amorphous. By controlling the growth process, for example by controlling the pH, the temperature and the stirrer speed during the precipitation reaction, it is possible to prepare dispersions having different particle sizes and/or specific surface areas. If necessary, the dispersions are stabilized with organic or inorganic bases, such as ammonia, amines, e.g. ethanolamines, sodium hydroxide, potassium hydroxide or lithium hydroxide.

The silicon dioxide particles usually have a particle size between 5 and 135 nm, preferably between 5 and 25 nm, and a specific surface area between 50 and 500 $m^2/g$, preferably between 100 and 150 $m^2/g$. The pH of the dispersion is in general between 5 and 10.

The aqueous dispersions of colloidal, anionically charged silicon dioxide particles include the preferred silica sols known from Ralph K. Iler, The Chemistry of Silicon, John Wiley and Sons, New York 1979. The preparation and properties of these silica sols is discussed in chapter 4 on pages 312 to 461. Silica sols of this type are available as ®Klebosol (trademark of the Société Française Hoechst) and are described in the Société Française Hoechst brochure, "Klebosol, sols de silice—silica sols—Kieselsole".

The anionic colloidal silicate solution used is in general from 5 to 65% strength by weight, preferably from 20 to 40% strength by weight, aqueous dispersion of colloidal, anionically charged silicon dioxide particles.

In the practise of the process according to the invention, the delimed and bated pelts are preferably pretreated with from 0.3 to 5.0% by weight, particularly preferably from 0.3 to 0.6% by weight, of an anionic, colloidal silicate solution, based on the weight of the pelts.

Thereafter the pH is adjusted with an aldehyde- and/or keto-carboxylic acid, preferably glyoxylic acid or pyruvic acid, with or without other organic and/or inorganic acids to less than 6, preferably 2.8–4.3. For this it is usually sufficient to add from 0.25 to 2.5% by weight of the aldehyde- and/or keto-carboxylic acid, based on the pickle weight of the pickle. Preference is given to using glyoxylic acid alone or combined with other organic and/or inorganic acids, such as formic acid and sulfuric acid.

Tanning is then carried out in the same bath using the usual commercially available chromium(III) tannins; even the modern, self-basifying chromium(III) tannins can be used without any problems.

If colloidal silicate solutions having a particle size of from 5 to 25 nm are combined in the pickle with those having a particle size between 26 and 135 nm and glyoxylic acid, the result obtained is a wet white which is readily splittable or shaveable (splitting and shaving wastes are aldehyde-, chromium- and aluminum-free; they are environmentally safe to recycle or dispose of) and then tannable with chrome tannins (or other tanning agents). The character of the chrome leather is not impaired by the pretreatment. The residual chrome content of the spent tanning liquors is below 100 mg of $Cr_2O_3$ per liter.

The process of the invention is notable for the very high degree of exhaustion of the chrome tannins. The residual chromium content of the spent tanning liquors is below 200 mg of $Cr_2O_3$ per liter.

The wet blue produced is particularly full, soft and noticeably light-colored. The light color of the wet blue does not have an adverse effect on the color build-up capacity of the later dyeing. Owing to the fullness and softness already achieved in the tanning process, the amount of retanning agent and fatliquor can be distinctly reduced in the wet finishing process.

The percentages are by weight.

Example 1

Pelt split to 2.2–2.5 mm

| | | | |
|---|---|---|---|
| Pickle: | 50.0% | water 25° C. | 2 hours |
| | 6.0% | sodium chloride | |
| | 0.5% | colloidal silicate solution 13 nm/25 nm | |
| + | 1.0% | glyoxylic acid 40% strength | 1–2 hours |
| | 0.26% | sulfuric acid 96% strength | |
| | 0.24% | formic acid 85% strength | |
| | | pH 3.5–4.0 | |
| + | 4.0% | chromium sulfate, 33% basic 24–26% of $Cr_2O_3$ | 1–1½ hours |
| | 0.4% | magnesium oxide | overnight |

Final temperature = 42 to 45° C.
Final pH = 4.0 to 4.4
$Cr_2O_3$ content of residual liquor = 55 to 70 mg/l
$Cr_2O_3$ content of leather (0% of $H_2O$) = 3.9 to 4.3%

Example 2

Unsplit pelt

| | | | |
|---|---|---|---|
| Pickle: | 45.0% | water 25° C. | 3 hours |
| | 6.0% | sodium chloride | |
| | 0.5–0.7% | colloidal silicate solution 13 nm/25 nm | |

-continued

Example 2

| | | | |
|---|---|---|---|
| + | 1.33–1.66% | glyoxylic acid 40% strength | 3–4 hours |
| | 0.35–0.44% | sulfuric acid 96% strength | |
| | 0.32-0.40% | formic acid 85% strength | |
| | | pH 3.2–4.0 | |
| + | 5.0–6.0% | chromium sulfate, 33% basic 24–26% of $Cr_2O_3$ | 2–4 hours |
| + | 0.3–0.5% | magnesium oxide | overnight |

Final temperature = 40 to 45° C.
Final pH = 4.0 to 4.5
$Cr_2O_3$ content of residual liquor = 60 to 80 mg/l Example 3

Unsplit pelt

| | | | |
|---|---|---|---|
| Pickle: | 45.0–50.0% | water 25° C. | 90 min |
| | 1.5% | colloidal silicate solution 8 nm/25 nm | |
| + | 1.5% | colloidal silicate solution 25–135 nm | 90 min |
| + | 6.0% | sodium chloride | 30 min |
| + | 1.33% | glyoxylic acid 40% strength | overnight |
| | 0.35% | sulfuric acid 95% strength | |
| | 32% | formic acid 85% strength | |
| | | pH 3.6–3.8 | |

Samming, splitting, shaving (0.2–0.3 nm below final thickness)
The following percentages are based on the shaved weight

| | | | |
|---|---|---|---|
| Tanning: | 80.0% | water 25° C. | 20 min |
| | 4.0% | sodium chloride | |
| | | pH 3.7 | |
| + | 7.0–8.0% | chromium sulfate, 33% basic 24–26% of $Cr_2O_3$ | 1–2 hours |
| + | 0.3–0.4% | magnesium oxide | overnight |

Final temperature = 40 to 45° C.
Final pH = 3.9 to 4.4
$Cr_2O_3$ content of residual liquor = 20 to 30 mg/l

What is claimed is:

1. A process for treatment of delimed and bated pelts which comprises:

contacting the delimed and bated pelts with an anionic, colloidal silicate in a pickle bath, and subsequent to said contacting, while said delimed and bated pelts are in the pickle bath, adding to the pickle bath an acid comprising an aldehyde- or keto-carboxylic acid or a combination of aldehyde- and keto-carboxylic acids.

2. The process of claim 1, wherein the anionic, colloidal silicate is in the form of an aqueous dispersion containing colloidal, anionically charged silicon dioxide particles.

3. The process of claim 2, wherein the aqueous dispersion comprises silicon dioxide particles having a particle size between 5 and 135 nm and a specific surface area of from 50 to 500 $m^2/g$.

4. The process of claim 2, wherein the aqueous dispersion has a concentration of from 5 to 65% by weight of colloidal anionically charged silicon dioxide particles.

5. The process of claim 2, wherein the amount of said aqueous dispersion with which said delimed and bated pelts are contacted ranges from 0.3 to 5.0% by weight, based on the weight of said pelts.

6. A process for economy and plumping chrome tanning of delimed and bated pelts which consists essentially of:

contacting the delimed and bated pelts with an anionic, colloidal silicate in a pickle bath, subsequent to said contacting, while said delimed and bated pelts are in the pickle bath, adding to the pickle bath an acid comprising an aldehyde- or keto-carboxylic acid or a combination of aldehyde- and keto-carboxylic acids, and chrome-tanning the delimed, bated, and pickled pelts after said adding.

7. The process of claim 6, wherein the anionic, colloidal silicate is in the form of an aqueous dispersion containing colloidal, anionically charged silicon dioxide particles.

8. The process of claim 7, wherein the aqueous dispersion comprises silicon dioxide particles having a particle size between 5 and 135 nm and a specific surface area of from 50 to 500 $m^2/g$.

9. The process of claim 7, wherein the aqueous dispersion has a concentration of from 5 to 65% by weight of colloidal anionically charged silicon dioxide particles.

10. The process of claim 7, wherein the amount of said aqueous dispersion with which said delimed and bated pelts are contacted ranges from 0.3 to 5.0% by weight, based on the weight of said pelts.

11. The process of claim 7, wherein said pickle bath, prior to said adding consists essentially of said aqueous dispersion containing colloidal, anionically charged silicon dioxide particles.

12. The process of claim 6, wherein said acid comprises glyoxylic acid.

13. The process of claim 6, wherein said acid comprises glyoxylic acid and formic acid or sulfuric acid.

14. The process of claim 7, wherein said adding results in a pH of less than 6 in the pickle bath.

15. The process of claim 6, wherein said chrome-tanning is carried out with a chromium availability of from 0.7 to 1.5% by weight of $Cr_2O_3$, based on the pelt weight, or from 0.7 to 2.5% by weight of $Cr_2O_3$, based on the shaved weight of said pelts.

16. The process of claim 6, wherein the anionic, colloidal silicate is in the form of a silica sol.

17. The process of claim 7, wherein the aqueous dispersion comprises silicon dioxide particles having a particle size between 5 and 25 nm and a specific surface area of from 100 to 150 $m^2/g$.

18. The process of claim 7, wherein the aqueous dispersion has a concentration of from 20 to 40% by weight of colloidal, anionically charged silicon dioxide particles.

19. The process of claim 7, wherein the amount of said aqueous dispersion with which said delimed and bated pelts are contacted ranges from 0.3 to 0.6% by weight, based on the weight of said pelts.

20. The process of claim 6, wherein the pickle bath, subsequent to said adding has a pH of from 2.8 to 4.3.

* * * * *